US008871414B2

(12) United States Patent
Tujihiro et al.

(10) Patent No.: US 8,871,414 B2
(45) Date of Patent: Oct. 28, 2014

(54) POSITIVELY CHARGEABLE TONER FOR ELECTROSTATIC IMAGE DEVELOPMENT

(75) Inventors: Masami Tujihiro, Osaka (JP); Toshiki Takemori, Osaka (JP)

(73) Assignee: Kyocera Document Solutions Inc., Osaka-Shi (JP)

( * ) Notice: Subject to any disclaimer, the term of this patent is extended or adjusted under 35 U.S.C. 154(b) by 7 days.

(21) Appl. No.: 13/357,166

(22) Filed: Jan. 24, 2012

(65) Prior Publication Data

US 2012/0189953 A1 Jul. 26, 2012

(30) Foreign Application Priority Data

| | | |
|---|---|---|
| Jan. 26, 2011 | (JP) | 2011-014050 |
| Feb. 3, 2011 | (JP) | 2011-022051 |
| Aug. 29, 2011 | (JP) | 2011-185776 |
| Aug. 30, 2011 | (JP) | 2011-188000 |

(51) Int. Cl.

| | |
|---|---|
| ***G03G 9/16*** | (2006.01) |
| ***G03G 9/09*** | (2006.01) |
| ***G03G 9/087*** | (2006.01) |
| ***G03G 9/08*** | (2006.01) |
| ***G03G 9/097*** | (2006.01) |

(52) U.S. Cl.

CPC ..... *G03G 9/081* (2013.01); *G03G 9/0904* (2013.01); *G03G 9/08708* (2013.01); *G03G 9/09775* (2013.01); *G03G 9/08755* (2013.01)

USPC ..... 430/108.2; 430/108.1

(58) Field of Classification Search

USPC ..... 430/108.1, 105, 108.22, 108.21, 108.2

See application file for complete search history.

(56) References Cited

U.S. PATENT DOCUMENTS

| | | | | |
|---|---|---|---|---|
| 6,221,548 | B1 | 4/2001 | Shiba et al. | |
| 2006/0286479 | A1* | 12/2006 | Inoue | 430/109.4 |
| 2007/0042283 | A1* | 2/2007 | Shibai et al. | 430/105 |
| 2008/0182198 | A1 | 7/2008 | Kawamura et al. | |
| 2009/0035680 | A1 | 2/2009 | Ishimoto et al. | |

(Continued)

FOREIGN PATENT DOCUMENTS

| | | | |
|---|---|---|---|
| JP | H05-188646 | A | 7/1993 |
| JP | 11-282204 | A | 10/1999 |

(Continued)

OTHER PUBLICATIONS

European Search Report issued for European Patent Application No. 12152312.0, mailed May 16, 2012.

(Continued)

*Primary Examiner* — Mark F Huff
*Assistant Examiner* — Rashid Alam
(74) *Attorney, Agent, or Firm* — Knobbe Martens Olson & Bear LLP

(57) ABSTRACT

Domains of a charge control resin are formed by dispersing a charge control resin containing a quaternary ammonium salt functional group-containing resin of a copolymer of an addition-polymerizable monomer having a quaternary ammonium salt functional group and a styrene and/or acrylic monomer into a polyester resin as binder resin, and the proportion of the number of domains of the charge control resin with a domain diameter of no less than 0.01 μm to less than 0.3 μm versus the number of domains of the charge control resin with a domain diameter of no less than 0.01 μm, which is measured by a predetermined method, is adjusted to no less than 98% by number.

9 Claims, 1 Drawing Sheet

(56) References Cited

U.S. PATENT DOCUMENTS

| | | | | |
|---|---|---|---|---|
| 2009/0246681 | A1* | 10/2009 | Kawamura et al. | 430/137.14 |
| 2010/0136469 | A1 | 6/2010 | Tajima et al. | |
| 2010/0233610 | A1* | 9/2010 | Fukui et al. | 430/108.22 |

FOREIGN PATENT DOCUMENTS

| | | | |
|---|---|---|---|
| JP | 11-282209 | A | 10/1999 |
| JP | H11-338195 | A | 12/1999 |
| JP | 2000-89517 | A | 3/2000 |
| JP | 2003-162099 | A | 6/2003 |
| JP | 2008-186002 | A | 8/2008 |
| JP | 2009-063736 | A | 3/2009 |
| JP | 2010-156952 | A | 7/2010 |
| WO | 2007141967 | A1 | 12/2007 |

OTHER PUBLICATIONS

Notice of Reasons for Rejection issued to JP Application No. 2011-188000, mailed Apr. 1, 2014.

Notice of Reasons for Rejection issued to corresponding JP Application No. 2011-185776 mailed Apr. 1, 2014.

* cited by examiner

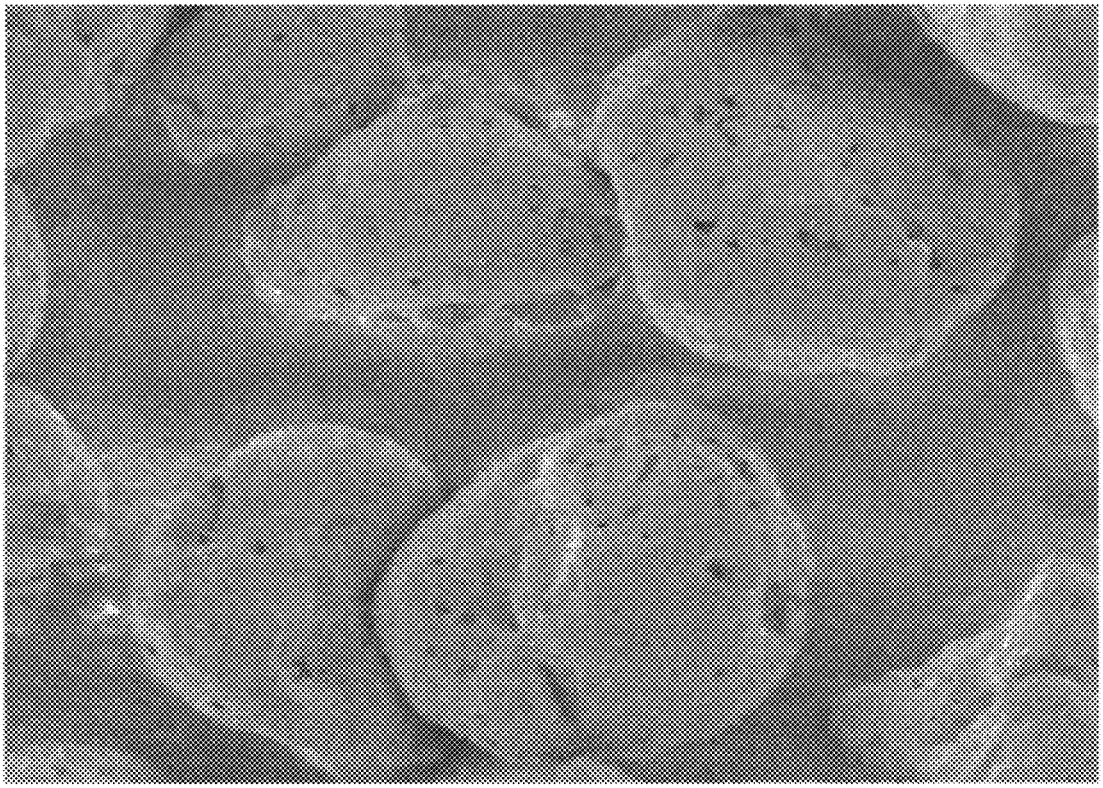

POSITIVELY CHARGEABLE TONER FOR ELECTROSTATIC IMAGE DEVELOPMENT

This application is based on and claims the benefit of priority from Japanese Patent Application Nos. 2011-014050, 2011-022051, 2011-185776 and 2011-188000, respectively filed on 26 Jan. 2011, 3 Feb. 2011, 29 Aug. 2011 and 30 Aug. 2011, the contents of which are incorporated herein by reference.

FIELD

Field of the Invention

The present disclosure relates to a positively chargeable toner for electrostatic image development.

BACKGROUND

In image forming methods such as electrophotography, in general, a surface of an electrostatic latent image carrier (photoconductor) is charged by corona discharge etc. and then exposed by laser etc. to form an electrostatic latent image, the electrostatic latent image is developed by a toner to form a toner image, and the toner image is further transferred on a recording medium to obtain an image with high quality. The toners used for forming toner images are usually those produced by mixing a binder resin such as thermoplastic resin with a colorant, a charge control agent, a release agent, etc., which are then kneaded, pulverized, classified to form toner particles with an average particle diameter of 5 to 10 μm. Then, in order to provide flowability to the toner, to control a charged amount of the toner, and to improve easiness of cleaning of the toner not transferred and remaining on the photoconductor, inorganic or inorganic metal fine particles such as silica and titanium oxide are externally added to the toner.

Recent years, longer operating life and higher speed are demanded in addition to higher image quality for image forming apparatuses using electrophotography etc. In order to respond to the demand for the image forming apparatuses, an initial rise of triboelectric charging capacity of the toner is important such that the toner can be stably charged to a desired charged amount in a short time. When the initial rise of triboelectric charging capacity of the toner is insufficient, since the development is carried out by the toner of inferior charge, problems such as increase of image density of formed images, generation of image fog in formed images, and toner scattering in image forming apparatuses tend to occur in case using two component developers and problems such as insufficient image density and image non-uniformity tend to occur in case using one component developers.

In order to solve the problems such as the initial rise of triboelectric charging capacity and the charge stability, for example, there is proposed a toner, on the surface of which positively chargeable charge control resin is adhered, by mixing an emulsion, consisting of an aqueous medium containing an organic solvent and a positively chargeable charge control resin, and a suspension of toner mother particles containing a binder resin of a polyester resin and a colorant, and adhering the positively chargeable charge control resin to the surface of the toner mother particles.

The toner described above is excellent in an initial development property since the initial rise of triboelectric charging capacity is excellent and the toner can be charged to a desired charged amount in a short time. However, the positively chargeable charge control resin of the toner described above is no more than one which merely adheres to the toner mother particles. For this reason, when printing with a lower coverage rate is carried out using the toner described above for a long period and thus the toner is stirred in development devices for a long period, the charge control resin tends to drop off from the surface of the toner mother particles. In such a case, since the toner mother particles consist of a polyester resin having negative charging properties, they tend to repel from a negatively charged carrier etc. and smear the image forming apparatuses due to scattering of the toner.

SUMMARY

The present disclosure has been made in view of the problems described above; and it is an object of the present disclosure to provide a positively chargeable toner for electrostatic image development which is excellent in initial rise of triboelectric charging capacity and the development property, which is unlikely to experience problems such as scattering of the toner even when the toner is stirred in development devices for a long period, and which is excellent in durability.

The present inventors have found that the problems described above can be solved by dispersing a charge control resin containing a quaternary ammonium salt functional group-containing resin of a copolymer of an addition-polymerizable monomer having a quaternary ammonium salt functional group and a styrene and/or acrylic monomer into a polyester resin as binder resin to form domains of the charge control resin and adjusting the proportion of the number of domains of the charge control resin with a domain diameter of no less than 0.01 μm to less than 0.3 μm versus the number of domains of the charge control resin with a domain diameter of no less than 0.01 μm, which is measured by a predetermined method, to be no less than 98% by number, thereby completing the present disclosure. Specifically, the present disclosure provides those explained below.

The present disclosure relates to a positively chargeable toner for electrostatic image development, comprising domains consisting of a charge control resin in a binder resin, wherein the binder resin is a polyester resin, the charge control resin contains a quaternary ammonium salt functional group-containing resin of a copolymer of an addition-polymerizable monomer having a quaternary ammonium salt functional group and a styrene and/or acrylic monomer, and the number % of the sum of N1 to N29 (Nn: number of domains consisting of the charge control resin of which the diameter of domains dispersed is no less than 0.01×n μm to less than 0.01×(n+1) μm; n: a positive integer of 1 or more) versus the total number of domains consisting of the charge control resin, for which the diameter of domains dispersed of no less than 50 by number of domains consisting of the charge control resin have been measured using an image of magnification 10,000× taken by a scanning electron microscope, is no less than 98% by number.

The present disclosure also relates to a positively chargeable toner for electrostatic image development, comprising charge control domains consisting of a mixture of a nitrogen atom-containing charge control agent and a charge control resin, wherein the binder resin is a polyester resin, the charge control resin contains a quaternary ammonium salt functional group-containing resin of a copolymer of an addition-polymerizable monomer having a quaternary ammonium salt functional group and a styrene and/or acrylic monomer, and the number % of the sum of N1 to N29 (Nn: number of domains consisting of the charge control resin of which the diameter of domains dispersed is no less than 0.01×n μm to less than 0.01×(n+1) μm; n: a positive integer of 1 or more)

versus the total number of domains consisting of the charge control resin, for which the diameter of domains dispersed of no less than 50 by number of domains consisting of the charge control resin have been measured using an image of magnification 10,000× taken by a scanning electron microscope, is no less than 98% by number.

BRIEF DESCRIPTION OF THE DRAWINGS

FIG. 1 is a view that shows an electron microscope photograph of the toner of Example 8 in which dropout traces of charge control domains are formed.

DETAILED DESCRIPTION OF EMBODIMENTS

The present disclosure is explained in detail with respect to embodiments below; however, the present disclosure is not limited at all to the embodiments below and may be carried out with appropriately making a change within the purpose of the present disclosure. In addition, explanation may be occasionally omitted with respect to duplicated matters; this does not however limit the gist of the present disclosure.

In the positively chargeable toner for electrostatic image development of the present disclosure (hereinafter also referred to as merely "toner"), the domains of the charge control resin are formed by dispersing the charge control resin, which contains a quaternary ammonium salt functional group-containing resin of a copolymer of an addition-polymerizable monomer having a quaternary ammonium salt functional group and a styrene and/or acrylic monomer, into a polyester resin as binder resin. The domains of the charge control resin are dispersed into the polyester resin such that the proportion of the number of domains of charge control resin with a diameter of domains dispersed of no less than 0.01 μm to less than 0.3 μm versus the number of domains of charge control resin with a diameter of domains dispersed of no less than 0.01 μm (hereinafter also referred to as "proportion of fine domains"), which is measured by a predetermined method, is no less than 98% by number. The toner of the present disclosure may contain a colorant, a release agent, or a charge control agent in the binder resin depending on requirements. The toner of the present disclosure may also be treated on the surface with an external additive as required. Furthermore, the toner of the present disclosure may be mixed with a desired carrier and used as a two component developer.

Binder resins, charge control resins, colorants, charge control agents, and external additives, which are essential or optional components to form the positively chargeable toner for electrostatic image development of the present disclosure, carriers which are used in a case of using the positively chargeable toner for electrostatic image development of the present disclosure as a two component developer, and methods for producing the positively chargeable toner for electrostatic image development of the present disclosure are explained below.

[Binder Resin]

The positively chargeable toner for electrostatic image development of the present disclosure uses a polyester resin as the binder resin. The polyester resin may be those resulting from condensation polymerization or co-condensation polymerization of alcohol components and carboxylic acid components. The components used for synthesizing the polyester resin may be exemplified by the alcohol components and carboxylic acid components below.

Bivalent, trivalent or higher-valent alcohols may be used as the alcohol component. Specific examples of the bivalent, trivalent or higher-valent alcohols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogen added bisphenol A, polyoxyethylenizied bisphenol A, and polyoxypropylenized bisphenol A; and trivalent or higher-valent alcohols such as sorbitol, 1,2,3,6-hexane tetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Bivalent, trivalent or higher-valent carboxylic acids may be used as the carboxylic acid component. Specific examples of the bivalent, trivalent or higher-valent carboxylic acids include bivalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, and malonic acid, or alkyl or alkenyl succinic acids including n-butyl succinic acid, n-butenyl succinic acid isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylenecarboxyl) methane, 1,2,7,8-octanetetracarboxylic acid, pyromellitic acid, and Enpol trimer. The bivalent, trivalent or higher-valent carboxylic acids may be used as ester-forming derivatives such as acid halides, acid anhydrides, and lower alkyl esters. The term "lower alkyl" means an alkyl group of 1 to 6 carbon atoms.

The softening temperature of the polyester resin is preferably 80° C. to 150° C. and more preferably 90° C. to 140° C.

[Charge Control Resin (CCR)]

In the positively chargeable toner for electrostatic image development of the present disclosure, positively chargeable domains consisting of the charge control resin are formed on the surface of the toner by mixing the charge control resin as an essential component, and colorants, release agents, charge control agents, etc. as optional components, and the binder resin and then melting and kneading them. The charge control resin may be a quaternary ammonium salt functional group-containing resin itself, alternatively a quaternary ammonium salt functional group-containing resin mixed with a polystyrene resin as required may be used.

The amount of the charge control resin used is not particularly limited provided that the amount is within a range that does not inhibit the purpose of the present disclosure. Typically, the amount of the charge control resin used is preferably such that the proportion of the area of domains of the charge control resin, which is a proportion of the total area of domains of the charge control resin in a toner cross-section versus a cross-sectional area of the toner, is 1% to 10% by area and more preferably 1.5% to 5.0% by area. When the proportion of the area of domains of the charge control resin is too small, the toner is unlikely to be charged to a desired charged amount. When the proportion of the area of domains of the charge control resin is too large, the toner is likely to be excessively charged and thus image defects tend to occur in formed images.

The proportion of the total area of domains of the charge control resin in a toner cross-section versus a cross-sectional area of the toner can be adjusted by controlling the amount of the charge control resin used or controlling the proportion of polystyrene resin in the charge control agent. The quaternary ammonium salt functional group-containing resin has a polar group; therefore, it exhibits slight compatibility with the polyester resin. However, the polarity of the charge control resin as entirety thereof can be lowered by increasing the content of the polystyrene resin in the charge control resin. For this reason, the amount of the charge control resin compatible with the polyester resin can be decreased and the proportion of the area of domains of the charge control resin can be raised by increasing the content of the polystyrene resin in the charge control resin.

The charge control resin is dispersed into the binder resin such that the proportion of the number of domains of the charge control resin with a diameter of domains dispersed (hereinafter also referred to as "domain diameter") of no less than 0.01 μm to less than 0.3 μm versus the number of domains of the charge control resin with a diameter of domains dispersed of no less than 0.01 μm (proportion of fine domains), which is measured by a predetermined method, is no less than 98% by number. It is further preferred that a diameter of a domain corresponding to 99% by number of domains from the smallest is 0.05 to 0.15 μm. The toner excellent in development property and durability can be obtained by dispersing the charge control resin into the binder resin in accordance with this embodiment.

Measurement of the proportion of the number of domains of the charge control resin with a domain diameter of no less than 0.01 μm to less than 0.3 μm versus the number of domains of the charge control resin with a domain diameter of no less than 0.01 μm (proportion of fine domains), the domain diameter of a domain corresponding to 99% by number from the smallest and the proportion of the area of domains of the charge control resin dispersed into the binder resin can be made using a sample in which a melted/kneaded material of the binder resin and the charge control resin obtained during production of the toner or the toner is embedded into an ultraviolet curable resin, etc. Specifically, the domain diameter of the charge control resin and the proportion of the area of domains can be measured in accordance with the process shown below. After a cross-section of a sample is polished to a mirror finish in advance, the sample is heat-treated at 58° C. for 12 hours. Then the sample, immersed into an aqueous ethanol solution (ethanol:water=80:20 by volume ratio), is introduced into an ultrasonic washer (UT-105S, by SHARP Co.) and ultrasonically treated for 5 minutes to prepare the sample from which domains of the charge control resin have dropped off. The cross-section of the melted/kneaded material or the toner is imaged by a scanning electron microscope to take a secondary electrophotographic image (magnification 10,000×) of dropout traces of domains of the charge control resin dispersed into the binder resin. The resulting image is binarized by an image analysis software (WinROOF, by MITANI Co.), thereby the diameter of dropout traces of domains of the charge control resin and the proportion of the area of domains of the charge control resin on the surface of the sample can be measured. In addition, measurement of the proportion of fine domains, the domain diameter, and the proportion of the area of domains of the charge control resin is carried out for the domains of the charge control resin having a domain diameter of no less than 0.01 μm. The reason is that it is difficult to observe domains having a domain diameter of less than 0.01 μm from electron microscope images at a magnification of times 10,000.

In accordance with the process described above, the domain diameters of 50 or more, and preferably 100 to 1000, domains of the charge control resin are measured. Then the number % of the sum of N1 to N29 (Nn: number of domains consisting of the charge control resin of which the diameter or domains dispersed is no less than 0.01×n μm to less than 0.01×(n+1) μm; n: a positive integer of 1 or more) versus the total number of domains of the charge control resin for which diameter of domains dispersed have been measured is calculated, thereby the number % of domains of the charge control resin with a diameter of domains dispersed of no less than 0.01 μm to less than 0.3 μm versus the number of domains of the charge control resin of no less than 0.01 μm can be determined.

Furthermore, the minimum value "n", at which the number % of the sum of N1 to Nn versus the total number of domains consisting of the charge control resin for which diameter of domains dispersed have been measured corresponds to 99% after rounding to an integer, is determined and 0.01×n μm is defined as the domain diameter (μm) of a domain of the charge control resin dispersed into the binder resin corresponding to 99% by number from the smallest.

A copolymer of an addition-polymerizable monomer having a quaternary ammonium salt functional group and a styrene and/or acrylic monomer is used as the quaternary ammonium salt functional group-containing resin. Since the quaternary ammonium salt functional group-containing resin is not compatible with the polyester resin as the binder resin, it is properly dispersed into the polyester. It is therefore easy to form the domains of the charge control resin dispersed at the surface of the toner under a desired condition when the quaternary ammonium salt functional group-containing resin is used.

Monomers derived through a quaternarization step from dialkylamino alkyl(meth)acrylate, dialkyl(meth)acrylamide, or dialkylamino alkyl(meth)acrylamide may be used for the addition-polymerizable monomer having a quaternary ammonium salt functional group. Specific examples of dialkylamino alkyl(meth)acrylate are dimethylamino ethyl (meth)acrylate, diethylamino ethyl(meth)acrylate, dipropylamino ethyl(meth)acrylate, dibutylamino ethyl(meth)acrylate, etc., for example. A specific example of dialkyl(meth) acrylamide is dimethyl methacrylamide. A specific example of dialkylamino alkyl(meth)acrylamide is dimethylamino propylmethacrylamide. Specific examples of reagents used for quaternarizing a tertiary amino group are halogenated alkyls of 1 to 6 carbon atoms such as methyl chloride, methyl bromide, and ethyl chloride; sulfonic acid esters as alkyl esters of 1 to 6 carbon atoms such as dimethyl sulfate and diethyl sulfate; and halogenated aralkyls of 7 to 10 carbon atoms such as benzyl chloride. The addition-polymerizable monomers having a quaternary ammonium salt functional group may be used in a combination of two or more.

In the quaternary ammonium salt functional group-containing resin, the amount of repeating units derived from the addition-polymerizable monomer having a quaternary ammonium salt functional group is not particularly limited providing that it is within a range that does not inhibit the purpose of the present disclosure. Specifically, the amount of repeating units derived from the addition-polymerizable monomer having a quaternary ammonium salt functional group is preferably 0.1% to 20% by mole and more preferably 0.5% to 10% by mole based on the total repeating units of the quaternary ammonium salt functional group-containing resin. When the amount of repeating units derived from the addition-polymerizable monomer having a quaternary ammonium salt functional group is too small, it is difficult to stably charge the toner to a desired charged amount. Therefore, image defects such as increase of image density of formed images and generation of image fog in formed images and toner scattering in image forming apparatuses are likely to occur in such cases. When the amount of repeating units derived from the addition-polymerizable monomer having a quaternary ammonium salt functional group is too high, image defects due to insufficient charge is likely to occur in formed images.

Various acrylic acid derivatives or methacrylic acid derivatives may be used as the acrylic monomer for producing the quaternary ammonium salt functional group-containing resin. Specific examples of preferable acrylic monomers are (meth)acrylates such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate; and other acrylic acid derivatives such as acrylonitrile, methacrylonitrile, and acrylamide. These acrylic monomers may be used in a combination of two or more.

The quaternary ammonium salt functional group-containing resin may be a copolymerization resin of an addition-polymerizable monomer having a quaternary ammonium salt functional group, a styrene and/or acrylic monomer, and an addition-polymerizable copolymerization monomer other than these monomers within a range not disturbing the purpose of the present disclosure. Specific examples of the copolymerization monomer are p-chlorostyrene; vinylnaphthalene; ethylenically unsaturated monoolefins such as ethylene, propylene, butylene, and isobutylene; halogenated vinyls such as vinyl chloride, vinyl bromide, and vinyl fluoride; vinyl esters such as vinyl acetate, vinyl propionate, vinyl benzoate, and vinyl butyrate; vinyl ethers such as vinyl methyl ether and vinyl isobutyl ether; vinyl ketones such as vinyl methyl ketone, vinyl ethyl ketone, and methyl isopropenyl ketone; and N-vinyl compounds such as N-vinyl pyrrole, N-vinyl carbazole, N-vinyl indole, and N-vinyl pyrrolidene. These copolymerization monomers may be copolymerized with styrene monomer in combination of two or more.

In the quaternary ammonium salt functional group-containing resin, the amount of repeating units derived from the copolymerization monomer other than the addition-polymerizable monomer having a quaternary ammonium salt functional group, styrene, and acrylic monomer is not particularly limited providing that it is within a range that does not inhibit the purpose of the present disclosure. Typically, the amount of repeating units derived from the copolymerization monomer is preferably no higher than 30% by mole and more preferably no higher than 10% by mole based on the total repeating units of the quaternary ammonium salt functional group-containing resin.

The quaternary ammonium salt functional group-containing resin can be prepared by copolymerizing the above-mentioned monomers combined in a desired ratio. The polymerization process for producing the quaternary ammonium salt functional group-containing resin may be optionally selected from solution polymerization, bulk polymerization, emulsion polymerization, suspension polymerization, etc. without particular limitation thereto.

In regards to the charge control resin, the quaternary ammonium salt functional group-containing resin may be singularly used, or a mixture of the quaternary ammonium salt functional group-containing resin and the polystyrene resin may also be used. In a case in which the mixture of the quaternary ammonium salt functional group-containing resin and the polystyrene resin is used, it is easy to produce the toner where the domains of the charge control resin are formed in a desired condition since the charge control resin is easily dispersed into the binder resin in particular when the binder resin and the charge control resin are melted and kneaded during production of the toner.

In the case in which the mixture of the quaternary ammonium salt functional group-containing resin and the polystyrene resin is used, the mixing process is not particularly limited as long as both are uniformly mixed. Specific examples of the process of mixing the quaternary ammonium salt functional group-containing resin and the polystyrene resin may be exemplified by a melting/kneading process using single screw extruders, twin screw extruders, etc. and a process in which the quaternary ammonium salt functional group-containing resin and the polystyrene resin are dissolved in an organic solvent and then the organic solvent is removed.

The polystyrene resin, mixed with the quaternary ammonium salt functional group-containing resin, may be a polymer of styrene by itself or a copolymer of styrene and a copolymerization monomer other than styrene. Specific examples of the copolymerization monomer usable with styrene are (meth)acrylates such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate; other acrylic acid derivatives such as acrylonitrile, methacrylonitrile, and acrylamide; p-chlorostyrene; vinylnaphthalene; ethylenically unsaturated monoolefins such as ethylene, propylene, butylene, and isobutylene; halogenated vinyls such as vinyl chloride, vinyl bromide, and vinyl fluoride; vinyl esters such as vinyl acetate, vinyl propionate, vinyl benzoate, and vinyl butyrate; vinyl ethers such as vinyl methyl ether and vinyl isobutyl ether; vinyl ketones such as vinyl methyl ketone, vinyl ethyl ketone, and methyl isopropenyl ketone; and N-vinyl compounds such as N-vinyl pyrrole, N-vinyl carbazole, N-vinyl indole, and N-vinyl pyrrolidene. These copolymerization monomers may be copolymerized with styrene monomer in combination of two or more.

In the polystyrene resin, the amount of repeating units derived from styrene is preferably no less than 70% by mole and more preferably no less than 90% by mole based on the total amount of repeating units of the polystyrene resin. Polystyrene of styrene homopolymer is particularly preferable among polystyrene resins since the proportion of the number of domains of the charge control resin with a domain diameter of no less than 0.01 μm to less than 0.3 μm versus the number of domains of the charge control resin with a domain diameter of no less than 0.01 μm and the proportion of the total area of domains of the charge control resin in a toner cross-section versus a cross-sectional area of the toner, which are measured by a predetermined process, may be easily adjusted into a predetermined range.

In a case of using the mixture of the quaternary ammonium salt functional group-containing resin and the polystyrene resin, the amount used of the polystyrene resin is not particularly limited providing that it is within a range that does not inhibit the purpose of the present disclosure. Typically, the amount of the polystyrene resin used is preferably 40 to 200 parts by mass, more preferably 20 to 120 parts by mass, and particularly preferably 20 to 70 parts by mass based on 100 parts by mass of the quaternary ammonium salt functional group-containing resin.

Furthermore, positively chargeable charge control domains, consisting of a mixture of a nitrogen atom-containing charge control agent and the charge control resin, may be formed in the positively chargeable toner for electrostatic image development of the present disclosure by dispersing the mixture of a nitrogen atom-containing charge control agent and the charge control resin into the binder resin in which a colorant, release agent, charge control agent, etc. have been mixed, as required.

The type of the nitrogen atom-containing charge control agent for forming the charge control domains is not particularly limited providing that it is within a range that does not inhibit the purpose of the present disclosure. The charge control agent may be appropriately selected from the nitrogen atom-containing charge control agents conventionally used for toners. Specific examples of the nitrogen atom-containing charge control agent are azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amine; alkylamido; quaternary ammonium salts such as benzylmethylhexyldecyl ammonium, and decyltrimethylammonium chloride; and the like. Among these charge control agents, quaternary ammonium salts are more preferable since they exhibit excellent affinity with the quaternary ammonium salt functional group-containing resin for obtaining toners with excellent durability. These nitrogen atom-containing charge control agents may be used in a combination of two or more.

The method for forming the charge control domains using the mixture of the charge control resin and the charge control agent is not particularly limited. For example, the charge control domains are formed by melting and kneading the mixture of the charge control resin and the charge control agent, having been uniformly mixed in advance, with the binder resin. The method for uniformly mixing the charge control resin and the charge control agent, which is not particularly limited, may be exemplified by a melting/kneading process, a process of dissolving the charge control resin and the charge control agent into a solvent such as toluene and xylene and then removing the solvent, and the like.

When the charge control agent is further added to the charge control resin, the amount used of the charge control agent is preferably 1% to 10% by mass and more preferably 3% to 8% by mass based on the total mass of the charge control resin and the charge control agent. When the charge control agent is used in an insufficient amount, difficulty in obtaining the toner with a desired charging property may result, and when an excessive amount is used, durability of the toner may be impaired.

The amount used of the mixture of the charge control resin and the charge control agent is not particularly limited providing that it is within a range that does not inhibit the purpose of the present disclosure. Typically, the amount used of the mixture of the charge control resin and the charge control agent is preferably such that the proportion of the area of charge control domains, which is a proportion of the total area of charge control domains in a toner cross-section versus a cross-sectional area of the toner, is 1% to 10% by area and more preferably 1.5% to 5.0% by area. When the proportion of the area of charge control domains is too small, the toner is unlikely to be charged to a desired charged amount; and when the proportion of the area of charge control domains is too large, the toner is likely to be excessively charged and thus image defects tend to occur in formed images.

Furthermore, the diameter of charge control domains dispersed into the binder resin (hereinafter also referred to as "domain diameter") is not particularly limited providing that it is within a range that does not inhibit the purpose of the present disclosure. The domain diameter of charge control domains and the diameter of a domain dispersed corresponding to 99% by number from the smallest can be measured by processes similar to those of the domains of charge control resin described above. Preferably, the charge control domains are formed in the binder resin such that the proportion of the number of charge control domains with a domain diameter of no less than 0.01 μm to less than 0.3 μm versus the number of charge control domains with a domain diameter of no less than 0.01 μm (hereinafter also referred to as "proportion of fine domains") is no less than 98% by number. It is also preferred for the diameter of domains dispersed of charge control domains that the diameter of the domain dispersed corresponding to 99% by number from the smallest is 0.01 to 0.3 μm. The toner excellent in development property and durability can be obtained by forming the charge control domains in the binder resin in accordance with this embodiment.

[Colorant]

The positively chargeable toner for electrostatic image development of the present disclosure may contain a colorant in the binder resin. Conventional pigments and dyes may be used as the colorant compounded in the binder resin depending on the color of the toner. Specific examples of appropriate colorants added to the toner include black pigments such as carbon black, acetylene black, lamp black, and aniline black; yellow pigments such as chrome yellow, zinc yellow, cadmium yellow, yellow iron oxide, mineral fast yellow, nickel titanium yellow, nables yellow, naphthol yellow S, hanza yellow G, hanza yellow 10G, benzizin yellow G, benzizin yellow GR, quinoline yellow lake, permanent yellow NCG, and turtrazin lake; orange pigments such as red chrome yellow, molybdenum orange, permanent orange GTR, pyrazolone orange, balcan orange, and indanthrene brilliant orange GK; red pigments such as iron oxide red, cadmium red, minium, cadmium mercury sulfate, permanent red 4R, lisol red, pyrazolone red, watching red calcium salt, lake red D, brilliant carmine 6B, eosine lake, rhodamine lake B, alizarin lake, and brilliant carmine 3B; violet pigments such as manganese violet, fast violet B, and methyl violet lake; blue pigments such as Berlin blue, cobalt blue, alkali blue lake, Victoria blue partially chlorinated product, fast sky blue, and indanthrene blue BC; green pigments such as chrome green, chromium oxide, pigment green B, malachite green lake, and final yellow green G; white pigments such as zinc white, titanium dioxide, antimony white, and zinc sulfate; and fillers such as baryta powder, barium carbonate, clay, silica, white carbon, talc, and alumina white. These colorants may be used in a combination of two or more for the purpose of tailoring the toner to a desired hue.

The amount used of the colorant is not particularly limited providing that it is within a range that does not inhibit the purpose of the present disclosure. Specifically, the amount used is preferably 1 to 10 parts by mass and more preferably 3 to 7 parts by mass based on 100 parts by mass of the binder resin.

[Release Agent]

The positively chargeable toner for electrostatic image development of the present disclosure may contain a release agent for the purpose of improving fixability and offset resistance of the toner. The type of the release agent compounded in the binder resin is not particularly limited providing that it is within a range that does not inhibit the purpose of the present disclosure. The release agent is preferably a wax; and examples of the wax include polyethylene wax, polypropylene wax, fluorine resin wax, Fischer-Tropsch wax, paraffin wax, ester wax, Montan wax, and rice wax. These waxes may be used in a combination of two or more. Generation of offset or image smearing (smear around images generating upon rubbing the images) may be effectively inhibited in formed images by adding the release agent to the toner.

The amount used of the release agent is not particularly limited providing that it is within a range that does not inhibit the purpose of the present disclosure. The specific amount used of the release agent is preferably 1 to 5 parts by mass based on 100 parts by mass of total amount of the toner. When the amount used of the release agent is insufficient, the desired effect may not be obtained for inhibiting the generation of offset or image smearing in formed images. When the amount used of the release agent is excessive, storage stability of the toner may be degraded due to fusion of the toner itself.

[Charge Control Agent]

The positively chargeable toner for electrostatic image development of the present disclosure may contain a positively chargeable charge control agent in the binder resin within a range that does not inhibit the purpose of the present disclosure.

The type of the charge control agent is not particularly limited providing that it is within a range that does not inhibit the purpose of the present disclosure. Those similar to the charge control agent used for forming the charge control domains from the charge control resin and the charge control agent may be used as the charge control agent.

[External Additive]

The positively chargeable toner for electrostatic image development of the present disclosure may be treated on the surface of toner mother particles with an external additive as required. The type of the external additive is not particularly limited provided that it is within a range that does not inhibit the purpose of the present disclosure. The external additive may be properly selected from those conventionally used for toners. Specific examples of the appropriate external additive include inorganic or metal oxides such as silica, alumina, titanium oxide, magnesium oxide, zinc oxide, strontium titanate, and barium titanate. These external additives may be used in a combination of two or more.

The particle diameter of the external additive is not particularly limited provided that it is within a range that does not inhibit the purpose of the present disclosure. Typically, the particle diameter of the external additive is preferably 0.01 to 1.0 μm.

The volume-specific resistance value of the external additive can be adjusted by forming a coating layer consisting of tin oxide and antimony oxide on a surface of the external additive and changing a thickness of the coating layer or a ratio of tin oxide to antimony oxide.

The amount used of the external additive is not particularly limited provided that it is within a range that does not inhibit the purpose of the present disclosure. Typically, the amount used of the external additive is preferably 0.1 to 10 parts by mass and more preferably 0.2 to 5 parts by mass based on 100 parts by mass of the toner particles before external treatment.

[Carrier]

The positively chargeable toner for electrostatic image development of the present disclosure may be mixed with a desired carrier and used as a two component developer. In a case of preparing the two component developer, a magnetic carrier is preferably used.

A carrier, of which core material is coated with a resin, is exemplified as the carrier which is preferable in the case of using the positively chargeable toner for electrostatic image development of the present disclosure as the two component developer. Specific examples of the material of carrier core are particles of iron, oxidized iron, reduced iron, magnetite, copper, silicon steel, ferrite, nickel, and cobalt; alloy particles of these materials and manganese, zinc, aluminum, etc.; alloy particles of iron-nickel alloy, iron-cobalt alloy, etc.; ceramic particles of titanium oxide, aluminum oxide, copper oxide, magnesium oxide, lead oxide, zirconium oxide, silicon carbide, magnesium titanate, barium titanate, lithium titanate, lead titanate, lead zirconate, lithium niobate, etc.; particles of higher permittivity materials such as ammonium dihydrogen phosphate, potassium dihydrogen phosphate, and Rochelle salts; resin carriers dispersing these magnetic particles into resins; and the like.

Specific examples of the resin, coating the core material of carrier, include (meth)acrylic polymer, styrene polymer, styrene-(meth)acrylic polymer, olefin polymer (polyethylene, chlorinated polyethylene, polypropylene, etc.), polyvinyl chloride, polyvinyl acetate, polycarbonate, cellulose resin, polyester resin, unsaturated polyester resin, polyamide resin, polyurethane resin, epoxy resin, silicone resin, fluorocarbon resin (polytetrafluoroethylene, polychlorotrifluoroethylene, polyvinylidene fluoride, etc.), phenol resin, xylene resin, diallyl phthalate resin, polyacetal resin, amino resin, etc. These resins may be used in a combination of two or more.

The particle diameter of the carrier, which is not particularly limited providing that it is within a range that does not inhibit the purpose of the present disclosure, is preferably 20 to 120 μm and more preferably 25 to 80 μm as a particle diameter measured by an electron microscope.

The apparent density of the carrier is not particularly limited providing that it is within a range that does not inhibit the purpose of the present disclosure. Typically, the apparent density of the carrier, which depends on a carrier composition and surface structure, is preferably 2,000 to 2,500 kg/m$^3$.

When the positively chargeable toner for electrostatic image development of the present disclosure is used as the two component developer, the content of the toner is preferably 3% to 20% by mass and more preferably 5% to 15% by mass based on the mass of the two component developer. By adjusting the content of the toner in the two component developer into the range, formed images may maintain an appropriate image density, and pollution inside image forming apparatuses, and adhesion of the toner to transfer paper etc. may be inhibited because of inhibiting toner scattering.

[Method for Producing Positively Chargeable Toner for Electrostatic Image Development]

The method for producing the positively chargeable toner for electrostatic image development of the present disclosure is explained below.

The positively chargeable toner for electrostatic image development of the present disclosure may be produced by mixing the charge control resin of an essential component and optional components such as a colorant, release agent, and charge control agent into the binder resin by a mixer, then melting and kneading them by a kneading machine such as extruders etc., followed by pulverizing and classifying the resulting kneaded material. The melting/kneading device for producing the positively chargeable toner for electrostatic image development may be appropriately selected from devices used for melting/kneading thermoplastic resins without particular limitation thereto. Specific examples of the kneading device include single or twin screw extruders. The average particle diameter of the pulverized/classified toner, which is not particularly limited providing that it is within a range that does not inhibit the purpose of the present disclosure, is preferably 5 to 10 μm in general.

In the positively chargeable toner for electrostatic image development of the present disclosure, the charge control resin is dispersed into the binder resin such that the proportion of the number of domains of the charge control resin with a domain diameter of no less than 0.01 μm to less than 0.3 μm versus the number of domains of the charge control resin with a domain diameter of no less than 0.01 μm (proportion of fine domains), which is measured by a predetermined method, is no less than 98% by number. The toner excellent in development property and durability can be obtained by adjusting the domain diameter of the charge control resin, dispersed into the binder resin, into the range.

The proportion of fine domains may be adjusted by properly controlling the melting/kneading conditions when producing the toner. Specific examples of the way to increase the proportion of fine domains include decrease of feed rate of materials to the kneading device and increase in residence time of kneaded materials in the kneading device. When the kneading device is an extruder, the residence time of kneaded materials may be extended by decreasing a revolution speed of an axis, using the kneading device with a larger L/D, or the like.

Besides, in a case in which the domains in the binder resin are formed from a mixture of the nitrogen atom-containing charge control agent and the charge control resin, domains are formed in the binder resin similarly as the process of forming the domains of the charge control resin described above.

The toner resulting from these processes may be treated on the surface by an external additive as required. The treatment process of the toner by the external additive may be properly selected from conventional treatment processes of external additives without particular limitation thereto. Specifically, treatment conditions are controlled such that particles of the external additive are not embedded into toner mother particles, then treatment of the external additive is carried out using a mixer such as Henschel mixer and Nautor mixer.

The positively chargeable toner for electrostatic image development of the present disclosure described above is excellent in the initial rise of triboelectric charging capacity and the development property, unlikely to cause problems such as scattering of the toner even when the toner is stirred in development devices for a long period, and excellent in durability, therefore can be favorably used in various image forming apparatuses.

EXAMPLES

The present disclosure is explained more specifically with reference to examples below. In addition, the present disclosure is not limited to the examples.

Binder resins and charge control resins used in Examples 1 to 7 and Comparative Examples 1 to 4 are explained below.

In Examples 1 to 7 and Comparative Examples 1 to 4, binder resins A to C (BR-A to BR-C) below were used as a binder resin:

Binder resin A (BR-A): polyester resin (Tafton NE-7200, by Kao Co.);

Binder resin B (BR-B): polyester resin (KM-PC-30, by Kao Co.); and

Binder resin C (BR-C): styrene-acrylic copolymer (Acrybase TIZ354-1, by Fujikurakasei Co.).

In Examples 1 to 7 and Comparative Examples 1 to 4, charge control resins A to D (CCR-A to CCR-D) below were used as a charge control resin:

Charge control resin A (CCR-A): mixture of quaternary ammonium salt functional group-containing resin and styrene prepared in Reference Example 1 below;

Charge control resin B (CCR-B): mixture of quaternary ammonium salt functional group-containing resin and styrene prepared in Reference Example 2 below;

Charge control resin C (CCR-C): mixture of quaternary ammonium salt functional group-containing resin and styrene prepared in Reference Example 3 below; and Charge control resin D (CCR-D): quaternary ammonium salt functional group-containing resin (FCA-201PS, by Fujikurakasei Co., content of units derived from monomers having a quaternary ammonium salt functional group: 5% by mole).

Reference Example 1

Thirty parts by mass of a quaternary ammonium salt functional group-containing resin (FCA-201PS, by Fujikurakasei Co., content of units derived from monomers having a quaternary ammonium salt functional group: 5% by mole) and 23 parts by mass of polystyrene (G100C, by Toyo Styrene Co.) were dissolved in 500 parts by mass of toluene. The solvent of the resulting solution was removed at 50° C. under reduced pressure to obtain CCR-A.

Reference Example 2

Thirty-five parts by mass of a quaternary ammonium salt functional group-containing resin (FCA-196, by Fujikurakasei Co.) and 25 parts by mass of polystyrene (G100C, by Toyo Styrene Co.) were dissolved in 500 parts by mass of toluene. The solvent of the resulting solution was removed at 50° C. under reduced pressure to obtain CCR-B.

Reference Example 3

Thirty parts by mass of a quaternary ammonium salt functional group-containing resin (FCA-201PS, by Fujikurakasei Co., content of units derived from monomers having a quaternary ammonium salt functional group: 5% by mole) and 60 parts by mass of polystyrene (G100C, by Toyo Styrene Co.) were dissolved in 500 parts by mass of toluene. The solvent of the resulting solution was removed at 50° C. under reduced pressure to obtain CCR-C.

Example 1

One hundred parts by mass of the binder resin BR-A, 5.5 parts by mass of Carnauba wax (release agent C1, by S. Kato. & Co.), 4 parts by mass of carbon black (colorant MA100, by Mitsubishi Chemical C.), and 5.3 parts by mass of the charge control resin CCR-A were mixed at 240 rpm using Henschel mixer (FM-20B, by Nippon Coke & Engineering Co.). The resulting mixture was melted and kneaded using a twin screw extruder (PCM-30, by Ikegai Co.) at 5 kg/hr of material feed rate, 160 rpm of shaft rotation number, and 100° C. to 130° C. of cylinder temperature. Then the resulting kneaded material was coarsely pulverized by Rotoplex mill (Model 8/16, by Toakikai Co.) and then finely milled by a jet mill (Model I ultrasonic jet mill, by Nippon Pneumatic Mfg. Co.), and the resulting finely milled material was classified by an elbow-jet (Model EJ-LABO, by Nittetsu Mining Co.) to obtain a black toner of a volume average particle diameter of 6.8 μm. To the resulting toner of 100 parts by mass, 1 parts by mass of fine particles of hydrophobic silica (RA-200H, by Japan Aerosil Co.) and 0.5 parts by mass of titanium oxide fine particle (ST-100, by Titan Kogyo, Ltd.) were added, which was then mixed by Henschel mixer (FM-20B, by Nippon Coke & Engineering Co.) to obtain an externally treated toner. The resulting toner was evaluated with respect to the proportion of the number of domains of the charge control resin with a domain diameter of no less than 0.01 μm to less than 0.3 μm versus the number of domains of the charge control resin with a domain diameter of no less than 0.01 μm (proportion of fine domains), the domain diameter of a domain of the charge control resin corresponding to 99% by number from the smallest, the proportion of the total area of domains of the charge control resin versus a cross-sectional area of the toner, development property, and durability in accordance with the processes below. The evaluation results of proportion of fine domains, domain diameter and proportion of the area of the charge control resin, development property, and durability are shown in Table 1.

(Measurement of Proportion of Fine Domains, Domain Diameter and Proportion of the Area of Domains of Charge Control Resin)

The kneaded material resulting from melting and kneading by the twin screw extruder in the toner production process was mounted to a polishing machine (Doctorlap ML-180SL, by Maruto Instrument Co.) and polished by sand papers of #220, #800, and #2000 in order. Additionally, the surface of the kneaded material was polished to a mirror finish using a diamond slurry of particle diameter 3 μm, a diamond slurry of particle diameter 1 μm, and alumina of particle diameter 0.1 μm in order. The sample of the mirror-finished melted/kneaded material was heated at 58° C. for 12 hours and then immersed into an aqueous ethanol solution (ethanol:water=80:20 by volume ratio) to ultrasonically treat for 5 minutes by an ultrasonic cleaner (UT-105S, by Sharp Co.). Domains of the charge control resin at the surface of the sample were dropped off by the ultrasonic treatment and dropout traces of the domains of the charge control resin were formed. After the ultrasonically-treated sample was dried, the surface of the sample was imaged for a secondary electrophotographic image (SEM photograph: magnification 10,000×) by a scanning electron microscope (SEM, JSM-7600F, by JEOL Ltd.). The resulting SEM photograph was binarized by an image analysis software (WinROOF, by MITANI Co.), and the proportion of fine domains, the diameter of dropout traces of domains of the charge control resin, and the proportion of the area of charge control domains at the surface of the sample were measured. In addition, the measurement of the proportion of fine domains, the domain diameter, and the proportion of the area of domains of the charge control resin was carried out for the domains of the charge control resin having a domain diameter of no less than 0.01 μm.

In accordance with the processes described above, domain diameters of domains consisting of the charge control resin were measured by the number of 328, and the number % of the sum of N1 to N29 (Nn: number of domains of the charge control resin of which the diameter of domains dispersed is no less than 0.01×n μm to less than 0.01×(n+1) μm; n: a positive integer of 1 or more) versus the total number of domains consisting of the charge control resin for which diameter of domains dispersed had been measured was calculated, thereby the number % of domains of the charge control resin with a domain diameter of no less than 0.01 μm to less than 0.3 μm versus the number of domains of the charge control resin with a domain diameter of no less than 0.01 μm was determined.

Furthermore, the minimum value "n", at which the number % of the sum of N1 to Nn versus the total number of domains consisting of the charge control resin for which diameter of a domain dispersed had been measured corresponds to 99% after rounding to an integer, was determined and 0.01×n μm was defined as the domain diameter (μm) of a domain of the charge control resin dipersed into the binder resin corresponding to 99% by number from the smallest of the domain of the charge control resin dispersed into the binder resin.

Development Property

A carrier (by Powder Tec. Co., volume resistivity value: $10^7$ Ω·cm, saturated magnetization: 70 emu/g, average particle diameter: 35 μm) used for a developer for TASKalfa 500ci and the externally treated toner were mixed such that the ratio of the toner to the total mass of the developer is 12% by mass, and then which was processed by a ball mill for 30 minutes to prepare a two component developer.

The resulting two component developer was installed to a black development section of a MFP (multi-functional peripheral, TASKalfa 500ci, by Kyocera Mita Co.), and a voltage (ΔV) between a development sleeve and a magnetic roll was set to 250 V and an AC voltage (Vpp) applied to the magnetic roll was set to 2.0 kV, then copy was carried out without paper and a solid image of 3 cm×3 cm was developed on an intermediate transfer body. The toner on the intermediate transfer body was collected by a filter of opening 5 μm using QM meter (by Trek Japan Co.), the weight of the collected toner was measured, and a toner amount per unit area as a toner development amount (mg/cm$^2$) in the solid image formed on the intermediate transfer body was measured. A charged amount of the toner was also measured by the QM meter (by Trek Japan Co., Model 210HS-1). In regards to the toner development amount of toner, no less than 0.8 mg/cm$^2$ of the toner development amount of toner was evaluated as good, and less than 0.8 mg/cm$^2$ thereof was evaluated as unsatisfactory. In regard to the charged amount, 20 to 27 μC/g was evaluated as good, and less than 20 μC/g and no less than 27 μC/g were evaluated as unsatisfactory.

Durability

The MFP (multi-functional peripheral), used for the evaluation of development property, was set to a condition printable to paper and subjected to a durability test in which 10,000 sheet printing (A4 sideways paper) was performed at a coverage rate of 5% under a condition of 20° C. and 60% RH. After the durability test, the weight of the toner scattered inside the MFP was measured. In regards to the toner after the durability test, the amount (% by mass) of oppositely charged toner as an index of toner scattering property was also measured using E-spurt analyzer (Model EST-III, by Hosokawa Micron Co.). In regards to the weight of scattered toner, no heavier than 100 mg was evaluated as good, heavier than 100 mg was evaluated as unsatisfactory. In regards to the amount of oppositely charged toner, no higher than 1% by mass was evaluated as good, and higher than 1% by mass was evaluated as unsatisfactory.

Example 2

An externally treated toner was obtained similarly as Example 1 except that the amount used of CCR-A was changed to 10.6 parts by mass. The evaluation results of proportion of fine domains, diameter of domains dispersed and proportion of the area of domains of the charge control resin, development property, and durability of the toner obtained in Example 2 are shown in Table 1. The total number of domains of the charge control resin was 238 for which a domain diameter was measured.

Example 3

An externally treated toner was obtained similarly as Example 1 except that the amount used of CCR-A was changed to 2.9 parts by mass. The evaluation results of proportion of fine domains, diameter of domains dispersed and proportion of the area of domains of the charge control resin, development property, and durability of the toner obtained in Example 3 are shown in Table 1. The total number of domains of the charge control resin was 203 for which a domain diameter was measured.

Example 4

An externally treated toner was obtained similarly as Example 1 except that CCR-B was used as the charge control resin and the amount used of charge control resin was 6 parts by mass. The evaluation results of proportion of fine domains, diameter of domains dispersed and proportion of the area of domains of the charge control resin, development property, and durability of the toner obtained in Example 4 are shown in Table 1. The total number of domains of the charge control resin was 425 for which a domain diameter was measured.

Example 5

An externally treated toner was obtained similarly as Example 1 except that BR-B was used as the binder resin. The evaluation results of proportion of fine domains, diameter of domains dispersed and proportion of the area of domains of the charge control resin, development property, and durability of the toner obtained in Example 5 are shown in Table 1. The total number of domains of the charge control resin was 546 for which a domain diameter was measured.

Example 6

An externally treated toner was obtained similarly as Example 1 except that CCR-C was used as the charge control resin and the amount used of the charge control resin was 9 parts by mass. The evaluation results of proportion of fine domains, diameter of domains dispersed and proportion of the area of domains of the charge control resin, development property, and durability of the toner obtained in Example 6 are shown in Table 1. The total number of domains of the charge control resin was 739 for which a domain diameter was measured.

Example 7

An externally treated toner was obtained similarly as Example 1 except that CCR-D was used as the charge control resin, the amount used of the charge control resin was 3.0 parts by mass, and the conditions of melting and kneading were changed to 1 kg/hr of material feed rate and 30 rpm of shaft rotation number. The evaluation results of proportion of fine domains, diameter of domains dispersed and proportion of area of domains of the charge control resin, development property, and durability of the toner obtained in Example 7 are shown in Table 1. The total number of domains of the charge control resin was 121 for which a domain diameter was measured.

Comparative Example 1

An externally treated toner was obtained similarly as Example 1 except that the amount used of CCR-A was changed to 14.3 parts by mass. The evaluation results of proportion of fine domains, diameter of domains dispersed and proportion of the area of domains of the charge control resin, and development property of the toner obtained in Comparative Example 1 are shown in Table 2. The toner obtained in Comparative Example 1 was unsatisfactory for development property thus durability was not evaluated. The total number of domains of the charge control resin was 84 for which a domain diameter was measured.

Comparative Example 2

An externally treated toner was obtained similarly as Example 1 except that CCR-D was used as the charge control resin and the amount used of the charge control resin was 3 parts by mass. The evaluation results of proportion of fine domains, diameter of domains dispersed and proportion of the area of domains of the charge control resin, development property, and durability of the toner obtained in Comparative Example 2 are shown in Table 2. The total number of domains of the charge control resin was 177 for which a domain diameter was measured.

Comparative Example 3

An externally treated toner was obtained similarly as Example 1 except that BR-C was used as the binder resin. The evaluation results of development property of the toner obtained in Comparative Example 3 are shown in Table 2. Domains of the charge control resin were not formed in the toner obtained in Comparative Example 3 since the binder resin and the charge control resin were compatible. The toner obtained in Comparative Example 3 was unsatisfactory for development property thus durability was not evaluated.

Comparative Example 4

An externally treated toner was obtained similarly as Comparative Example 3 except that the amount used of CCR-A was 1.8 parts by mass. The evaluation results of development property and durability of the toner obtained in Comparative Example 4 are shown in Table 2. Domains of the charge control resin were not formed in the toner obtained in Comparative Example 4 since the binder resin and the charge control resin were compatible.

TABLE 1

| | Example | | | | | | |
|---|---|---|---|---|---|---|---|
| | 1 | 2 | 3 | 4 | 5 | 6 | 7 |
| binder resin | | | | | | | |
| amount used | 100 | 100 | 100 | 100 | 100 | 100 | 100 |
| type | BR-A | BR-A | BR-A | BR-A | BR-B | BR-A | BR-A |
| charge control resin | | | | | | | |
| amount used | 5.3 | 10.6 | 2.9 | 6.0 | 5.3 | 9.0 | 3.0 |
| type | CCR-A | CCR-A | CCR-A | CCR-B | CCR-A | CCR-C | CCR-D |
| proportion of fine domains (% by number) | 100.0 | 100.0 | 100.0 | 100.0 | 100.0 | 99.2 | 99.2 |
| domain diameter (μm) | 0.13 | 0.20 | 0.09 | 0.13 | 0.15 | 0.28 | 0.29 |
| Proportion of area of domains (%) | 1.6 | 2.4 | 1.0 | 2.2 | 3.5 | 8.8 | 1.2 |
| development property | | | | | | | |
| development amount ($mg/cm^2$) | 0.97 | 0.80 | 1.00 | 0.93 | 0.91 | 0.82 | 1.13 |
| evaluation | good | good | good | good | good | good | good |
| charged amount (μC/g) | 23.6 | 25.3 | 22.2 | 25.3 | 25.4 | 26.8 | 21.2 |
| evaluation | good | good | good | good | good | good | good |
| durability | | | | | | | |
| scatterd amount (mg) | 43 | 56 | 94 | 52 | 70 | 35 | 95 |
| evaluation | good | good | good | good | good | good | good |
| Oppositely charged amount (% by mass) | 0.10 | 0.23 | 0.80 | 0.47 | 0.62 | 0.80 | 0.95 |
| evaluation | good | good | good | good | good | good | good |

TABLE 2

| | Comparative Example | | | |
|---|---|---|---|---|
| | 1 | 2 | 3 | 4 |
| binder resin | | | | |
| amount used | 100 | 100 | 100 | 100 |
| type | BR-A | BR-A | BR-C | BR-C |
| charge control resin | | | | |
| amount used | 14.3 | 3.0 | 5.3 | 1.8 |
| type | CCR-A | CCR-D | CCR-A | CCR-A |
| proportion of fine domains (% by number) | 79.8 | 97.2 | — | — |
| domain diameter (μm) | 0.76 | 0.39 | — | — |
| Proportion of area of domains (%) | 4.1 | 2.1 | — | — |
| development property | | | | |
| development amount ($mg/cm^2$) | 0.34 | 0.86 | 0.37 | 0.82 |
| evaluation | bad | good | bad | good |
| Charged amount (μC/g) | 30.6 | 26.4 | 35.3 | 24.2 |
| evaluation | bad | good | bad | good |
| durability | | | | |
| scatterd amount (mg) | — | 132 | — | 215 |
| evaluation | — | bad | — | bad |
| Oppositely charged amount (% by mass) | — | 4.3 | — | 5.3 |
| evaluation | — | bad | — | bad |

It is understood from Examples 1 to 7 that toners with excellent development property and durability can be obtained when the polyester resin not compatible with the charge control resin is used as the binder resin, quaternary ammonium salt functional group-containing resin is used as the charge control resin, and the charge control resin is dispersed into the binder resin such that the proportion of the number of domains of the charge control resin with a domain diameter of no less than 0.01 μm to less than 0.3 μm versus the number of domains of the charge control resin with a domain diameter of no less than 0.01 μm (proportion of fine domains) is no less than 98% by number.

On the other hand, it is understood from Comparative Example 1 that when the proportion of fine domains is significantly lower than 98% by number, the development amount of the toner is decreased since the charged amount of the toner is too high due to the effect of coarse domains and thus the toner with desired development property cannot be obtained even when polyester resin is used as the binder resin. It is also understood from Comparative Example 2 that the desired development property is obtainable when the proportion of fine domains is in a level of 97.2% by number even when the proportion of fine domains is lower than 98% by number, but the toner with excellent durability cannot be obtained after all. It is believed that the toner of Comparative Example 2 is inferior in durability since the coarse domains of the charge control resin tend to drop off from the surface of the toner.

It is also understood from Comparative Example 3 that when the styrene-acrylic resin compatible with the charge control resin is used as the binder resin and domains of the charge control resin are not formed at the surface of the toner, use of the charge control agent of 5.3 parts by mass based on 100 parts by mass of the binder resin leads to decrease of the development amount of the toner due to too high charged amount of the toner, thus the toner with desired development property cannot be obtained. It is also understood from Comparative Example 4 that the charged amount of the toner may be adjusted to a proper level by decreasing the amount used of the charge control resin from that of Comparative Example 3, but merely the toner with poor durability is obtained.

Examples 8 to 12 and Comparative Examples 5 to 8

In Examples 8 to 12 and Comparative Examples 5 to 8, RES1 and RES2 below were used as a resin included in charge control domains:

RES1: quaternary ammonium salt functional group-containing resin (FCA-196P, by Fujikurakasei Co., content of units derived from monomers having a quaternary ammonium salt functional group: 5% by mole); and RES2: polystyrene (G100C, by Toyo Styrene Co.).

In Examples 8 to 12 and Comparative Examples 5 to 8, CCA1 and CCA2 below were used as a nitrogen atom-containing charge control agent included in charge control domains:

CCA1: quaternary ammonium salt-containing charge control agent BONTRON P-51 (by Orient Chemical Industries Co.); and CCA2: azine compound-containing charge control agent BONTRON N-21 (by Orient Chemical Industries Co.).

Example 8

Production of Charge Control Domain Material

A charge control domain material was prepared in accordance with the process below. Fifty parts by mass of the quaternary ammonium salt functional group-containing resin (RES1) and 4 parts by mass of the quaternary ammonium salt charge control agent (CCA1) were dissolved in 500 parts by mass of toluene. The solvent of the resulting solution was removed at 50° C. under reduced pressure to obtain a charge control domain material 1 (CCD-1).

(Production of Toner)

One hundred parts by mass of polyester resin (binder resin, Tafton NE-7200, by Kao Co.), 5.5 parts by mass of Carnauba wax (release agent C1, by S. Kato. & Co.), 4 parts by mass of carbon black (colorant MA100, by Mitsubishi Chemical C.), and 8.8 parts by mass of charge control domain material 1 (CCD1) were mixed at 240 rpm using Henschel mixer (FM-20B, by Nippon Coke & Engineering Co.). The resulting mixture was melted and kneaded using a twin screw extruder (PCM-30, by Ikegai Co.) at 5 kg/hr of material feed rate, 160 rpm of shaft rotation number, and 130° C. of cylinder temperature followed by cooling, then the resulting kneaded material was coarsely pulverized by Rotoplex mill (Model 8/16, by Toakikai Co.) and then finely milled by a jet mill (Model I ultrasonic jet mill, by Nippon Pneumatic Mfg. Co.), and the resulting finely milled material was classified by an elbow-jet (Model EJ-LABO, by Nittetsu Mining Co.) to obtain a black toner of a volume average particle diameter of 6.8 μm. To the resulting toner of 100 parts by mass, 1 part by mass of fine particles of hydrophobic silica (RA-200H, by Japan Aerosil Co.) and 0.5 parts by mass of titanium oxide fine particle (ST-100, by Titan Kogyo, Ltd.) were added as an external additive, which was then mixed by Henschel mixer (FM-20B, by Nippon Coke & Engineering Co.) to obtain an externally treated toner.

Using the resulting toner, existence of charge control domains was confirmed at the surface of the toner in accordance with the process below. As a result, dropout traces of charge control domains were observed at the surface of the toner, and it could be confirmed that charge control domains were formed at the surface of the toner.

Method for Confirming Charge Control Domains

A toner of 60±0.1 mg was precisely weighed into a sample tube of 50 ml, then an aqueous ethanol solution (ethanol: water=80:20 by volume ratio) of 10 ml was added to the sample tube. The sample tube was immersed into an ultrasonic cleaner (UT-105S, by Sharp Co.) where water had been poured to a water height of 15 mm, then to which ultrasonic wave was irradiated for 5 minutes at the maximum stage thereof. The ultrasonically-treated sample in the sample tube was filtered by a filter paper (No. 2, by Toyo Roshi Kaisha, Ltd.) to collect the toner, and the collected toner was vacuum dried. The dried toner was imaged for a secondary electrophotographic image (magnification 10,000×) by a scanning electron microscope (SEM, JSM-7600F, by JEOL Ltd.), and whether or not charge control domains had been formed was confirmed from the resulting SEM photograph of the toner based on existence or non-existence of dropout traces of charge control domains at the surface of the toner. FIG. 1 shows a secondary electrophotographic image of the toner of Example 8 in which dropout traces of charge control domain were formed. The dropout traces of charge control domains can be confirmed at the surface of the toner in view of FIG. 1, and it is demonstrated that charge control domains have been formed at the surface of the toner of Example 8.

The resulting toner was also measured in terms of proportion of the number of charge control domains with a domain diameter of no less than 0.01 μm to less than 0.3 μm versus the number of charge control domains with a domain diameter of no less than 0.01 μm (proportion of fine domains), domain diameter of a charge control domain corresponding to 99% by number from the smallest, and proportion of the area of charge control domains.

Measurement of Proportion of Fine Domains, and Domain Diameter and Proportion of the Area of Charge Control Domains The kneaded material resulting from melting and kneading by the twin screw extruder in the toner production process was mounted to a polishing machine (Doctorlap ML-180SL, by Maruto Instrument Co.) and polished by sand papers of #220, #800, and #2000 in order. Additionally, the surface of the kneaded material was polished to a mirror finish using a diamond slurry of particle diameter 3 μm, a diamond slurry of particle diameter 1 μm, and alumina of particle diameter 0.1 μm in order. The sample of the mirror-finished melted/kneaded material was heated at 58° C. for 12 hours and then immersed into an aqueous ethanol solution (ethanol:water=80:20 by volume ratio) to ultrasonically treat for 5 minutes by an ultrasonic cleaner (UT-105S, by Sharp Co.). Charge control domains at the surface of the sample were dropped off by the ultrasonic treatment and dropout traces of the charge control domains were formed. After the ultrasonically-treated sample was dried, the surface of the sample was imaged for a secondary electrophotographic image (magnification 10,000×) by a scanning electron microscope (JSM-7600F, by JEOL Ltd.). The resulting SEM photography was binarized by an image analysis software (WinROOF, by MITANI Co.), and the proportion of fine domains, the diameter of a dropout trace of charge control domain corresponding to 99% by number from the smallest and the proportion of the area of charge control domains at the surface of the sample were measured. In addition, the measurement of the proportion of fine domains, the domain diameter, and the proportion of the area of charge control domains was carried out for the charge control domains having a domain diameter of no less than 0.01 μm.

In accordance with the processes described above, domain diameters of charge control domains were measured by the number of 324, and the number % of the sum of N1 to N29 (Nn: number of charge control domains of which the diameter of domains dispersed is no less than 0.01×n μm to less than 0.01×(n+1) μm; n: a positive integer of 1 or more) versus the total number of charge control domains for which diameter of domains dispersed had been measured was calculated, thereby the number % of charge control domains with a domain diameter of no less than 0.01 μm to less than 0.3 μm versus the number of charge control domains with a domain diameter of no less than 0.01 μm was determined.

Furthermore, the minimum value "n", at which the number % of the sum of N1 to Nn versus the total number of charge control domains for which diameter of a domain dispersed had been measured corresponds to 99% after rounding to an integer, was determined and 0.01×n μm was defined as the domain diameter (μm) of a charge control domain dispersed into the binder resin correspond to 99% by number from the smallest.

Additionally, development property and durability were evaluated in accordance with the processes below using the resulting toner.

Development Property

A carrier used for a developer for TASKalfa 500ci (multi-functional peripheral, by Kyocera Mita Co.) and the externally treated toner were mixed such that the ratio of the toner to the total mass of the developer was 12% by mass, and then which was processed by a ball mill for 30 minutes to prepare a two component developer. The resulting two component developer was installed to a black development section of the multi-functional peripheral (TASKalfa 500ci, by Kyocera Mita Co.), and a voltage (ΔV) between a development sleeve and a magnetic roll was set to 250 V and an AC voltage (Vpp) applied to the magnetic roll was set to 2.0 kV, then copy was carried out without paper and a solid image of 3 cm×3 cm was developed on an intermediate transfer body. The toner on the intermediate transfer body was collected by a filter of opening 5 μm using QM meter (Model 210HS-1, by Trek Japan Co.), the weight of the collected toner was measured, and a toner amount per unit area (mg/cm$^2$) in the solid image formed on the intermediate transfer body was measured as a toner development amount. A charged amount of the toner was also measured by the QM meter (Model 210HS-1, by Trek Japan Co.). In regards to the toner development amount of toner, no less than 0.8 mg/cm$^2$ of the toner development amount of toner was evaluated as good, and less than 0.8 mg/cm$^2$ thereof was evaluated as unsatisfactory. In regard to the charged amount, 20 to 27 μC/g was evaluated as good, and less than 20 μC/g and no less than 27 μC/g were evaluated as unsatisfactory.

Durability

The multi-functional peripheral, used for the evaluation of development property, was set to a condition printable to paper and subjected to a durability test in which 10,000 sheet printing was performed at a coverage rate of 5% under normal condition of temperature and humidity (20° C. and 60% RH). After the durability test, the weight of the toner scattered inside the MFP (multi-functional peripheral) was measured. A charged amount of the toner after the durability test was also measured by the QM meter (Model 210HS-1, by Trek Japan Co.). Additionally, in regards to the toner after the durability test, the amount (% by mass) of oppositely charged toner as an index of toner scattering property was measured using E-spurt analyzer (Model EST-III, by Hosokawa Micron Co.). In regards to the weight of scattered toner, no heavier than 100 mg was evaluated as good, heavier than 100 mg was evaluated as unsatisfactory. In regard to the charged amount of toner, 12 to 27 μC/g was evaluated as good, and less than 12 μC/g and no less than 27 μC/g were evaluated as unsatisfactory. In regards to the amount of oppositely charged toner, no higher than 1% by mass was evaluated as good, and higher than 1% by mass was evaluated as unsatisfactory.

Example 9

An externally treated toner was obtained similarly as Example 8 except that the amount used of the charge control domain material 1 (CCD1) was changed to 16.5 parts by mass. The evaluation results of proportion of fine domains, domain diameter of a charge control domain corresponding to 99% by number from the smallest and proportion of the area of charge control domains, development property, and durability of the toner obtained in Example 9 are shown in Table 3. The total number of charge control domains was 224 for which a domain diameter was measured.

Example 10

An externally treated toner was obtained similarly as Example 8 except that the amount used of the charge control domain material 1 (CCD1) was changed to 4.4 parts by mass. The evaluation results of proportion of fine domains, domain diameter of a charge control domain corresponding to 99% by number from the smallest and proportion of the area of charge control domains, development property, and durability of the toner obtained in Example 10 are shown in Table 3. The total number of charge control domains was 203 for which a domain diameter was measured.

Example 11

Production of Charge Control Domain Material

A charge control domain material was prepared in accordance with the process below. Fifty parts by mass of the quaternary ammonium salt functional group-containing resin (RES1) and 5 parts by mass of the azine compound charge control agent (CCA2) were dissolved in 500 parts by mass of toluene. The solvent of the resulting solution was removed at 50° C. under reduced pressure to obtain a charge control domain material 2 (CCD2).

(Production of Toner)

An externally treated toner was obtained similarly as Example 8 except that the charge control domain material 1 (CCD1) was changed to the charge control domain material 2 (CCD2). The evaluation results of proportion of fine domains, domain diameter of a charge control domain corresponding to 99% by number from the smallest and proportion of the area of charge control domains, development property, and durability of the toner obtained in Example 11 are shown in Table 3. The total number of charge control domains was 425 for which a domain diameter was measured.

Example 12

Production of Charge Control Domain Material

A charge control domain material was prepared in accordance with the process below. Thirty parts by mass of the quaternary ammonium salt functional group-containing resin (RES1), 23 parts by mass of polystyrene (RES2), and 4 parts by mass of the quaternary ammonium salt charge control agent (CCA1) were dissolved in 500 parts by mass of toluene. The solvent of the resulting solution was removed at 50° C. under reduced pressure to obtain a charge control domain material 3 (CCD3).

(Production of Toner)

An externally treated toner was obtained similarly as Example 8 except that the charge control domain material was changed from the charge control domain material 1 (CCD1) to the charge control domain material 3 (CCD3) and the amount used of the charge control domain material was changed from 8.8 parts by mass to 11.4 parts by mass. The evaluation results of proportion of fine domains, domain diameter of a charge control domain corresponding to 99% by number from the smallest and proportion of the area of charge control domains, development property, and durability of the toner obtained in Example 12 are shown in Table 3. The total number of charge control domains was 121 for which a domain diameter was measured.

Comparative Example 5

An externally treated toner was obtained similarly as Example 8 except that 8.0 parts by mass of the quaternary ammonium salt functional group-containing resin (RES1) and 0.8 parts by mass of the quaternary ammonium salt charge control agent (CCA1), which had not been mixed, were used in place of the charge control domain material 1 (CCD1). The evaluation results of proportion of fine domains, domain diameter of a charge control domain corresponding to 99% by number from the smallest and proportion of the area of charge control domains, development property, and durability of the toner obtained in Comparative Example 5 are shown in Table 4. The total number of charge control domains was 67 for which a domain diameter was measured. The toner obtained in Comparative Example 5 was unsatisfactory for development property thus durability was not evaluated.

Comparative Example 6

An externally treated toner was obtained similarly as Comparative Example 5 except that the amount used of the quaternary ammonium salt charge control agent (CCA1) was changed to 3.0 parts by mass. The evaluation results of proportion of fine domains, domain diameter of a charge control domain corresponding to 99% by number from the smallest and proportion of the area of charge control domains, development property, and durability of the toner obtained in Comparative Example 6 are shown in Table 4. The total number of charge control domains was 84 for which a domain diameter was measured.

Comparative Example 7

An externally treated toner was obtained similarly as Example 8 except that 3.0 parts by mass of the quaternary ammonium salt charge control agent (CCA1) was used in place of the charge control domain material 1 (CCD1). The evaluation results of development property and durability of the toner obtained in Comparative Example 7 are shown in Table 4.

Comparative Example 8

(Production of Charge Control Domain Material)

A charge control domain material was prepared in accordance with the process below. Fifty parts by mass of polystyrene (RES2) and 5 parts by mass of the quaternary ammonium salt charge control agent (CCA1) were dissolved in 500 parts by mass of toluene. The solvent of the resulting solution was removed at 50° C. under reduced pressure to obtain a charge control domain material 4 (CCD4).

(Production of Toner)

An externally treated toner was obtained similarly as Example 8 except that the charge control domain material 1 (CCD1) was changed to the charge control domain material 4 (CCD4). The evaluation results of proportion of fine domains, domain diameter of a charge control domain corresponding to 99% by number from the smallest and proportion of the area of charge control domains, development property, and durability of the toner obtained in Comparative Example 8 are shown in Table 4. The total number of charge control domains was 177 for which a domain diameter was measured.

TABLE 3

| | Example | | | | |
|---|---|---|---|---|---|
| | 8 | 9 | 10 | 11 | 12 |
| binder resin | | | | | |
| amount used (parts by mass) | 100 | 100 | 100 | 100 | 100 |
| charge control domain material | | | | | |
| amount used (parts by mass) | 8.8 | 16.5 | 4.4 | 8.8 | 11.4 |
| type | CCD1 | CCD1 | CCD1 | CCD2 | CCD3 |
| mixing in advance | done | done | done | done | done |
| Charge control resin/ polystylene | | | | | |
| amount used (parts by mass) | 8.0 | 15.0 | 4.0 | 8.0 | 6.0/4.6 |
| type | RES1 | RES1 | RES1 | RES1 | RES1/RES2 |
| charge control agent | | | | | |
| amount used (parts by mass) | 0.8 | 1.5 | 0.4 | 0.8 | 0.8 |
| type | CCA1 | CCA1 | CCA1 | CCA2 | CCA1 |
| existence or non-existence of charge control domains | existence | existence | existence | existence | existence |
| proportion of fine domains (% by number) | 100.0 | 98.7 | 100.0 | 100.0 | 99.2 |
| domain diameter of a domain corresponding to 99% by number (μm) | 0.13 | 0.30 | 0.09 | 0.13 | 0.29 |
| Proportion of area of domains (%) | 1.6 | 5.1 | 1.0 | 2.2 | 1.2 |

TABLE 3-continued

| | Example | | | | |
|---|---|---|---|---|---|
| | 8 | 9 | 10 | 11 | 12 |
| development property | | | | | |
| development amount (mg/cm$^2$) | 1.12 | 0.98 | 1.32 | 0.84 | 1.23 |
| evaluation | good | good | good | good | good |
| charged amount (μC/g) | 23.6 | 24.8 | 21.4 | 26.5 | 22.4 |
| evaluation | good | good | good | good | good |
| durability | | | | | |
| scattered amount (mg) | 46 | 32 | 90 | 83 | 30 |
| evaluation | good | good | good | good | good |
| charged amount (μC/g) | 18.6 | 20.6 | 12.3 | 13.2 | 20.2 |
| evaluation | good | good | good | good | good |
| oppositely charged amount (% by mass) | 0.12 | 0.32 | 0.83 | 0.75 | 0.10 |
| evaluation | good | good | good | good | good |

TABLE 4

| | Comparative Example | | | |
|---|---|---|---|---|
| | 5 | 6 | 7 | 8 |
| binder resin | | | | |
| amount used (parts by mass) | 100 | 100 | 100 | 100 |
| charge control domain material | | | | |
| amount used (parts by mass) | 8.8 | 11.0 | 3.0 | 8.8 |
| type | — | — | — | CCD4 |
| mixing in advance | not done | not done | — | done |
| Charge control resin/ polystylene | | | | |
| amount used (parts by mass) | 8.0 | 8.0 | — | 8.0 |
| type | RES1 | RES1 | — | RES2 |
| charge control agent | | | | |
| amount used (parts by mass) | 0.8 | 3.0 | 3.0 | 0.8 |
| type | CCA1 | CCA1 | CCA1 | CCA1 |
| existence or non-existence of charge control domains | existence | exist-ence | not-exist-ence | exist-ence |
| proportion of fine domains (% by number) | 76.1 | 79.8 | — | 97.2 |
| domain diameter of a domain corresponding to 99% by number (μm) | 0.53 | 0.76 | — | 0.39 |
| Proportion of area of domains (%) | 3.3 | 4.1 | — | 2.1 |
| development property | | | | |
| development amount (mg/cm$^2$) | 0.32 | 1.05 | 0.92 | 1.34 |
| Evaluation | bad | good | good | good |
| charged amount (μC/g) | 35.2 | 25.3 | 22.6 | 20.2 |
| Evaluation | bad | good | good | good |
| Durability | | | | |
| scattered amount (mg) | — | 362 | 630 | 120 |
| evaluation | — | bad | bad | bad |
| charged amount (μC/g) | — | 10.3 | 8.2 | 11.2 |
| evaluation | — | bad | bad | bad |
| oppositely charged amount (% by mass) | — | 2.50 | 6.50 | 2.10 |
| evaluation | — | bad | bad | bad |

In regards to the toners of Examples 8 to 12, charge control domains are formed at the surface of the toner by including the nitrogen atom-containing charge control agent into the charge control resin not compatible with polyester resin and then melting and kneading the charge control resin and the polyester resin; therefore, the nitrogen atom-containing charge control agent included into the charge control resin is mostly not dispersed into the polyester resin. For this reason, the toners of Examples 8 to 12 exhibit good charging property and are excellent in development property since the charge control agent exists densely in the charge control domains at the surface of the toner. Furthermore, since the charge control agent and the charge control resin have a high affinity due to similar chemical structure and thus the charge control agent in the charge control domains is unlikely to drop off even when the toner is used for a long period, toners with excellent durability could be obtained in Examples 8 to 12.

It is understood from Comparative Example 5 that the charged amount of the toner is too high when the nitrogen atom-containing charge control agent and the charge control resin, which have not been uniformly mixed in advance, are compounded to the polyester resin to prepare a toner. For this reason, a toner excellent in development property could not be obtained in Comparative Example 5.

The toner of Comparative Example 6 is excellent in the development property since the amount used of the nitrogen atom-containing charge control agent is remarkably increased from that of the toner of Comparative Example 5 and thus a large amount of the charge control agent is exposed at the surface of the toner. However, most of the charge control agent is exposed at the polyester resin portion of the surface of the toner and thus the affinity between the polyester resin and the charge control agent is not so high in the toner of Comparative Example 6; therefore, the charge control agent easily drops off from the surface of the toner when the toner is used for a long period. For this reason, the toner of Comparison Example 6 is poor in durability.

The toner of Comparative Example 7 was prepared by compounding the nitrogen atom-containing charge control agent in the same amount of Comparative Example 6 directly to the polyester resin without using the charge control resin. For this reason, the charge control agent is exposed at the surface of the toner almost similarly as the toner of Comparative Example 6, thus the toner excellent in development property was obtained similarly as Comparative Example 6. However, the toner of Comparative Example 7 is poor in durability by a reason similar to that of the toner of Comparative Example 6.

In the toner of Comparative Example 8, the charge control domains are formed at the surface of the toner by including the nitrogen atom-containing charge control agent into the polystyrene, not compatible with polyester resin, and then melting and kneading the mixture of the charge control agent and polystyrene and the polyester resin; therefore, the nitrogen atom-containing charge control agent included into the polystyrene is hardly dispersed into the polyester resin. For this reason, the toner of Comparative Example 8 exhibits good charging property and is excellent in development property since the charge control agent exists densely in the charge control domains at the surface of the toner. However, the affinity between the charge control agent and the polystyrene resin is not so high; therefore, the charge control agent easily drops off from the charge control domains when the toner is used for a long period. For this reason, the toner of Comparison Example 8 is poor in durability.

It is also understood from Examples 10 and 12 that the toner particularly excellent in initial development property as well as excellent in durability can be obtained when the domain diameter of a charge control domain corresponding to 99% by number from the smallest is no larger than 0.3 μm and the proportion of the area of charge control domains to the binder resin is 1% to 10% by area.

It is further understood from Examples 8 and 11 that the toner particularly excellent in both of development property and durability can be obtained when the nitrogen atom-containing charge control agent is a quaternary ammonium salt compared to the cases where nitrogen atom-containing charge control material of other chemical structure (azine type) is used as the nitrogen atom-containing charge control agent.

What is claimed is:

1. A positively chargeable toner for electrostatic image development, comprising a binder resin and a mixture of a styrene resin and a quaternary ammonium salt functional group-containing resin of a copolymer of an addition-polymerizable monomer having a quaternary ammonium salt functional group, a styrene monomer and acrylic monomer, wherein the mixture of the styrene resin and the quaternary ammonium salt functional group-containing resin forms domains, which are not compatible with the binder resin, in the binder resin, the binder resin is a polyester resin which is a polycondensate of one or more alcohol components selected from bivalent, trivalent or higher-valent alcohols and one or more carboxylic acid components selected from bivalent, trivalent or higher-valent carboxylic acids, and the number % of the sum of N1 to N29 (Nn: number of domains consisting of the mixture of the styrene resin and the quaternary ammonium salt functional group-containing resin of which the diameter of domains dispersed is no less than 0.01×n μm to less than 0.01×(n+1) μm; n: a positive integer of 1 or more) versus the total number of domains consisting of the charge control resin, for which the diameter of domains dispersed of no less than 50 by number of domains consisting of the mixture of the styrene resin and the quaternary ammonium salt functional group-containing resin have been measured using an image of magnification 10,000× taken by a scanning electron microscope, is no less than 98% by number.

2. The positively chargeable toner for electrostatic image development according to claim 1, wherein proportion of total area of domains consisting of the mixture of the styrene resin and the quaternary ammonium salt functional group-containing resin charge control resin versus the cross-sectional area of the toner is 1% to 10% by area.

3. The positively chargeable toner for electrostatic image development according to claim 1, wherein the content of the styrene resin in the mixture of the styrene resin and the quaternary ammonium salt functional group-containing resin is 40 to 200 parts by mass based on 100 parts by mass of the quaternary ammonium salt functional group-containing resin.

4. The positively chargeable toner for electrostatic image development according to claim 1, wherein proportion of repeating units derived from the addition-polymerizable monomer having a quaternary ammonium salt functional group versus the total repeating units of the quaternary ammonium salt functional group-containing resin is 0.1% to 20% by mole in the quaternary ammonium salt functional group-containing resin.

5. A positively chargeable toner for electrostatic image development, comprising a binder resin and a mixture of a nitrogen atom-containing charge control agent and a charge control resin, wherein the mixture of the nitrogen atom-containing charge control agent and the charge control resin forms domains which are not compatible with the binder resin in the binder resin, the binder resin is a polyester resin which is a polycondensate of one or more alcohol components selected from bivalent, trivalent or higher-valent alcohols and one or more carboxylic acid components selected from bivalent, trivalent or higher-valent carboxylic acids, the charge control resin contains a quaternary ammonium salt functional group-containing resin of a copolymer of an addition-polymerizable monomer having a quaternary ammonium salt functional group and a styrene monomer and acrylic monomer, and the number % of the sum of N1 to N29 (Nn: number of domains consisting of the charge control resin of which the diameter of domains dispersed is no less than 0.01×n μm to less than 0.01×(n+1) μm; n: a positive integer of 1 or more) versus the total number of domains consisting of the charge control resin, for which the diameter of domains dispersed of no less than 50 by number of domains consisting of the charge control resin have been measured using an image of magnification 10,000× taken by a scanning electron microscope, is no less than 98% by number.

6. The positively chargeable toner for electrostatic image development according to claim 5, wherein proportion of total area of the charge control domains versus the cross-sectional area of the toner is 1% to 10% by area.

7. The positively chargeable toner for electrostatic image development according to claim 5, wherein the amount of the nitrogen atom-containing charge control agent in the toner is 1% to 10% by mass based on the total mass of the nitrogen atom-containing charge control agent in the toner and the charge control resin.

8. The positively chargeable toner for electrostatic image development according to claim 5, wherein the nitrogen atom-containing charge control agent is a quaternary ammonium salt.

9. The positively chargeable toner for electrostatic image development according to claim 5, wherein the amount of repeating units derived from the addition-polymerizable monomer having a quaternary ammonium salt functional group versus the total repeating units of the quaternary ammonium salt functional group-containing resin is 0.1% to 20% by mole in the quaternary ammonium salt functional group-containing resin.

* * * * *